US008931709B2

(12) United States Patent
Christ

(10) Patent No.: US 8,931,709 B2
(45) Date of Patent: Jan. 13, 2015

(54) RAIL

(75) Inventor: Thomas Christ, Muehlhausen (DE)

(73) Assignees: Voestalpine BWG GmbH & Co. KG, Butzbach (DE); Voestalpine VAE GmbH, Vienna (DE)

( * ) Notice: Subject to any disclaimer, the term of this patent is extended or adjusted under 35 U.S.C. 154(b) by 348 days.

(21) Appl. No.: 13/381,562

(22) PCT Filed: Jun. 29, 2010

(86) PCT No.: PCT/EP2010/059162

§ 371 (c)(1),
(2), (4) Date: Mar. 19, 2012

(87) PCT Pub. No.: WO2011/000809

PCT Pub. Date: Jan. 6, 2011

(65) Prior Publication Data

US 2012/0168569 A1 Jul. 5, 2012

(30) Foreign Application Priority Data

Jun. 29, 2009 (DE) ..... 10 2009 026 049

(51) Int. Cl.
*E01B 5/00* (2006.01)
*E01B 5/08* (2006.01)
*E01B 5/10* (2006.01)

(52) U.S. Cl.
CPC .... *E01B 5/08* (2013.01); *E01B 5/10* (2013.01)
USPC ..... 238/143; 238/142

(58) Field of Classification Search
USPC ..... 238/122, 123, 124, 125, 126, 127, 128, 238/132, 135, 148, 149, 140, 141, 146
See application file for complete search history.

(56) References Cited

U.S. PATENT DOCUMENTS

| | | | | | |
|---|---|---|---|---|---|
| 1,060,371 | A * | 4/1913 | Slick | 238/143 |
| 1,068,814 | A * | 7/1913 | Noll | 238/143 |
| 1,068,815 | A * | 7/1913 | Noll | 238/143 |
| 1,098,635 | A * | 6/1914 | Pearson | 238/142 |
| 1,287,096 | A * | 12/1918 | Puttergill | 238/143 |
| 1,695,730 | A * | 12/1928 | Grohs | 238/132 |
| 1,856,911 | A * | 5/1932 | Faries et al. | 238/143 |
| 4,801,083 | A | 1/1989 | Arteaga et al. | |
| 5,622,312 | A * | 4/1997 | Martin | 238/2 |
| 6,471,138 | B1 * | 10/2002 | Blank et al. | 238/122 |
| 2008/0017727 | A1 * | 1/2008 | Frank et al. | 238/122 |
| 2012/0168569 | A1 * | 7/2012 | Christ | 246/435 R |

FOREIGN PATENT DOCUMENTS

| | | |
|---|---|---|
| CH | 284745 | 8/1952 |
| DE | 602182 | 9/1934 |
| DE | 1217990 | 6/1966 |
| DE | 69605022 | 6/2000 |
| DE | 29824701 | 6/2002 |
| DE | 10112979 | 7/2002 |
| DE | 10-2004048751 | 12/2005 |
| DE | 10-2005024441 | 11/2006 |
| EP | 1524364 | 4/2005 |
| WO | 2004081286 | 9/2004 |

* cited by examiner

*Primary Examiner* — Jason C Smith
(74) *Attorney, Agent, or Firm* — Ladas & Parry LLP

(57) ABSTRACT

A rail or grooved rail having upper and lower parts made of different materials, the upper part having a head and being made of a water-resistant material, and the lower part being made of structural steel, and wherein the lower part of the rail is a profile element having a web or a flat element forming a web.

16 Claims, 4 Drawing Sheets

RAIL

This application is a 371 of PCT/EP2010/059162, filed Jun. 29, 2010, which claims priority to German Patent Application No. 10 2009 026 049.8, filed Jun. 29, 2009, which is incorporated herein by reference.

The invention relates to a rail, in particular a grooved rail, comprising an upper part and a single-part lower part, which consist of different materials and which are connected metallurgically, whereby the upper part comprises a head and consists of a wear-resistant material while the lower part preferably consists of structural steel and comprises a web.

Rails must operate under a variety of stresses and conditions. In particular in areas of points, a dragging motion between wheel and rail becomes noticeable. In particular rigid rails at the beginning of switching devices are subject to high wear during trailing point movements. Consequently, there exist a vast number of suggestions on how to achieve long service life in the region of points. For example, rigid rails may be formed from one block of wear-resistant steel, all the way from head to foot (EP-A-1 524 364, DE-A-10 2004 048 751, or DE-U-298 24 701).

Known from DE-B-10 2004 048 751 is a switching device, for which a rigid rail is manufactured from a base block of a wear-resistant weldable tempering steel.

DE-T-696 05 022 concerns a rail that consists of a rail head and an H-shaped monolithic box design into which the head can be inserted.

Other designs call for a division between an upper part comprising a head and a lower structure, whereby the upper part may consist of a blade cradle of a steel of high-tensile quality whereas the lower part consists of structural steel (DE-C-101 12 979).

In order to reduce wear in the crossing area of a grooved built-up frog while at the same time allowing replacement by simple measures, WO-A-2004/081286 suggests a replaceable insert consisting of a wear-resistant material.

Also known in the art are so-called monoblock switching devices, whereby the block for cost reasons forms the centre part of a switching device, which is embodied in a box shape to accommodate the tongue blade. Continuing rails are welded to the block, which can result in discontinuities on account of the welding joints.

Known from U.S. Pat. No. 4,801,083 is a multipart rail that comprises a head with channels extending in parallel relative to each other on the head's lower side and longitudinal flanges of L-shaped profile elements engaging into these, whereby the profile's transverse flanges are connected to a base plate. The individual parts are connected by bolts in order to allow a problem-free replacement of elements.

Disclosed in DE-C-602 182 is a rail that comprises a head of a wear-resistant material and a foot made of the standard rail material, whereby head and foot are welded along or in proximity to the neutral axis.

The present invention is based on the objective to further develop a rail of the above-mentioned type in a way so that it can be manufactured at low cost, is optimized with respect to the employed materials, and at the same time possesses a lower weight in comparison to the block design.

To meet this objective, the invention fundamentally intends that the upper part forms the head and possesses a cuboid shape, that the lower side of the head be connected to the lower part at least metallurgically, and that the lower part of the rail be a profiled element possessing a web or a flat element forming the web, whereby at least the profiled element possesses a base section extending transverse relative to the web.

In conformity with the state of technology, the invention provides a rail that comprises an upper part consisting of a wear-resistant material and a lower part that is manufactured from low-cost materials such as structural steel. However, one does not choose a block-unit construction design, which would result in significantly higher costs and weight. One rather uses a profiled or flat element, which is available at low cost, possesses the desired geometries, and is comparatively light-weight, without having to accept losses with respect to load-carrying capacity.

Further and differing from the generic state of technology, the invention intends for a lower part that is connected metallurgically, in particular welded, to the lower side of the cuboid-shaped upper part. In addition, the head and the foot part may interlock in a form-fitting manner. For this purpose one also has the option that the web of the profiled element or flat element or an upper flange of an I-profile be inserted into a corresponding longitudinal slot of the head part to which it is subsequently welded. It is also possible for the lower side of the head part to possess two sections that extend in parallel and are joined by a step, whereby the web is in contact with the step and subsequently is welded to the lower part. A design of the same type with a step-like embodied lower side is also feasible when using an I-profile, whereby the upper flange of the profiled element can be inserted in a form-fitting manner into the region of the lower side.

Irrespectively hereof, it is in particular intended—also differing from the generic state of technology—that the profiled element or the flat element comprise a base section that forms a foot with a geometry that is different from that of a foot of a standard rail. The base section in particular possesses a cuboid geometry. It may also be provided that the width of base section be smaller than that of a foot of a standard rail. The term standard rail includes standard grooved rail.

In particular it is intended that the profiled element be a U-, L-, Z-, T-, or I-profile that can be produced by rolling, bending, or from flat products, such as sheet steel or flat steel.

For example, it is possible to combine two pieces of sheet steel by welding to form a T-profile, in order to make available a profiled element. Accordingly, sheet steel or flat steel may be bent and/or joined to obtain the desired profile geometry.

As mentioned, the lower part is welded to the upper part or is connected in another suitable metallurgical manner, whereby in particular a supplementary form-fitting connection is provided.

Irrespective thereof, the profiled or flat elements should possess a minimum wall thickness of 10 mm, in particular in a range between 10 mm and 20 mm.

For the purpose of connecting the upper and the lower part in a form-fitting manner, the latter may on its lower side possess a slot-like recess, into which engages in a form-fitting manner the profiled element or flat element or a section of these. Welding may subsequently be performed at the freely accessible contact locations. Into the corresponding slot-like cut-out may be inserted the upper flange of the I-beam or the free end of the web of the L-profile, T-profile, or the flat element.

If the state of technology intends for the use of wear-resistant steels as a continuous block from head to foot on the one hand and for a two-part embodiment with solid rectangular profile for the head and a block-like lower support structure on the other, the invention in contrast suggests a material-saving lower support structure that consists of a profile or flat element and performs the functions of foot and web of a rail. This allows significant cost savings for materials compared to designs known in the art. Irrespectively thereof, the rail head consist of a wear-resistant material.

The term cuboid shape encompasses an upper part manufactured by rolling, extrusion, or other shaping process, whereby in the case of a grooved rail, a groove is incorporated.

The lower side of the head should comprise at least one level plane extending in parallel relative to the base section, i.e. relative to the foot print, or level planes that are connected via a step, in order to be able to connect, as described above, the profiled element or flat element to the head part in a metallurgical and preferably form-fitting manner, in particular to said plane.

In further development of the invention it is intended that the lower part be connected to the upper part in a one-sided form-fitting manner. The term one-sided form-fitting means that a form-fit is achieved in the direction of a force acting upon the upper part as result of a vehicle passing the rail. A curved rail, for example, will be loaded mainly by the centrifugal force of the vehicle along a force vector to the arc outside, so that the form-fit will be provided on the arc inside.

If an L-profile is used as the lower part, the web is connected to the upper part and its flange forms half of the foot of the rail. In order to ensure a secure attachment of the rail despite this fact it is intended that on the side of the web opposite to the side of the flange, plate elements be attached, e.g. by welding to the web in the foot area in the region of the tie-down locations of the rail.

In particular it is intended that the rail according to the invention be arranged as a rail for crossings and turnouts within points and series of points. This means that the rail can be employed as simple rail, as a fabricated check rail and/or weld-on rail for cross frogs, or as a rigid rail, and/or standard rail within switching devices.

Preferably it is intended that the rail be employed as a rigid rail of a switching device, whereby the rail extends from the beginning to the end of the switching device in its design according to the invention. However it is also possible to install the invention's rail as a rigid rail from the beginning to the end of the switch opening in a switching device.

The invention's rail can be employed as a grooved rail or Vignoles rail, for example.

Further details, advantages, and features of the invention are not only found in the claims, the characteristic claims disclosed therein—on their own and/or in combination—but also in the following description of preferred embodiment examples illustrated in the figures.

The figures show:

Figure 6:
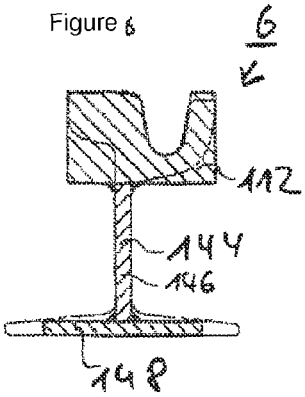
Figure 7:
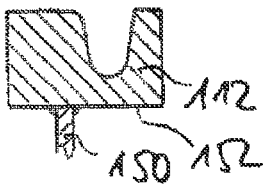
Figure 8:
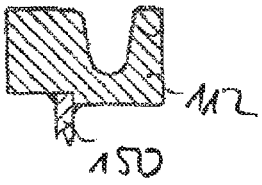
Figure 9:
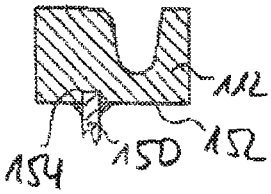
Figure 10:
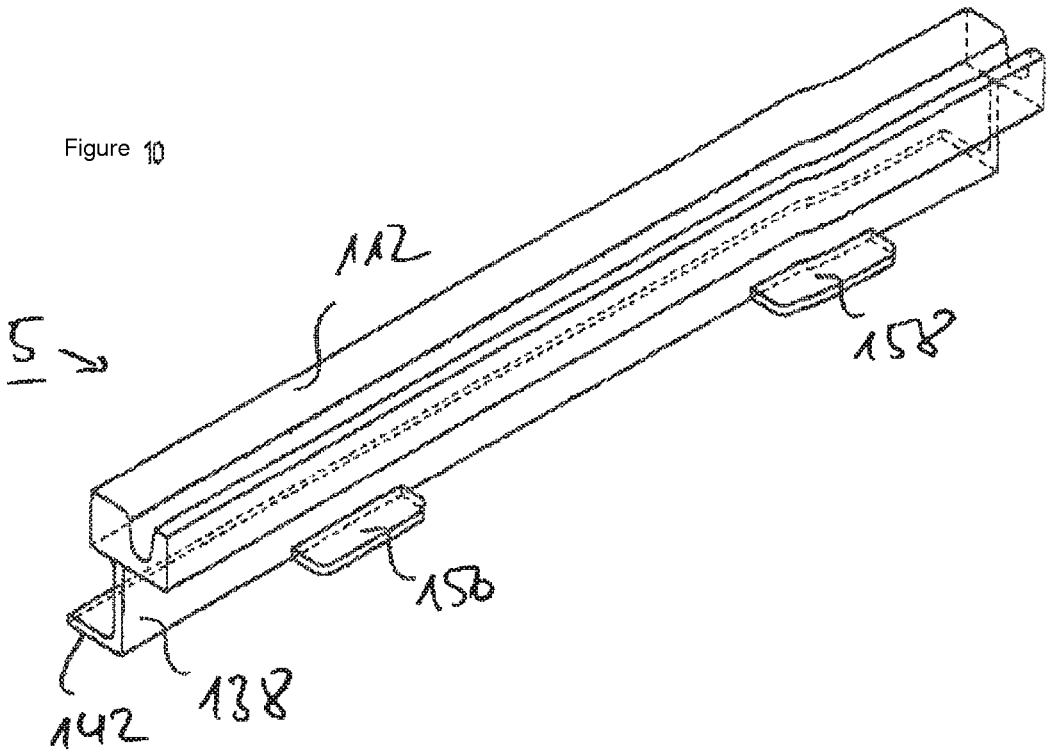
Figure 23:
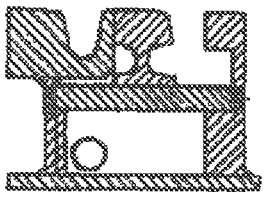
Figure 24:
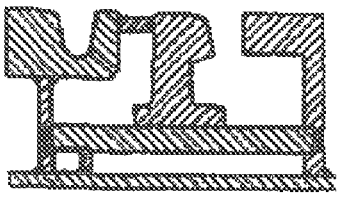
Figure 11:
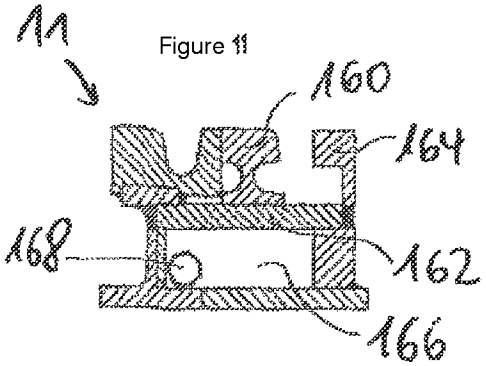
Figure 12:
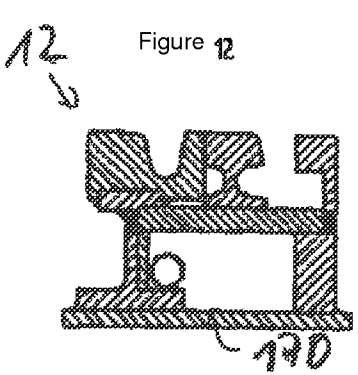
Figure 14:
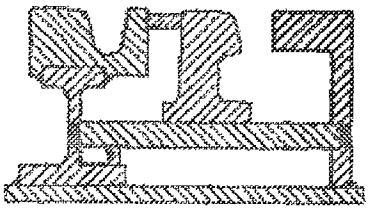
Figure 15:
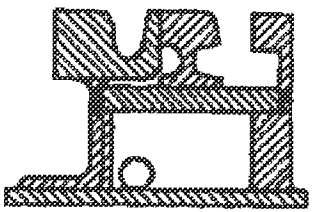
Figure 16:
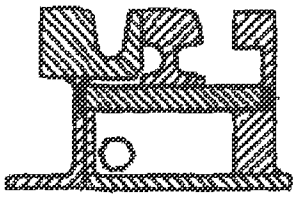
Figure 19:
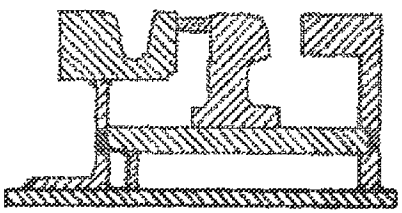
Figure 18:
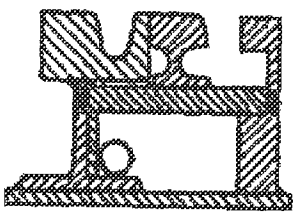
Figure 20:
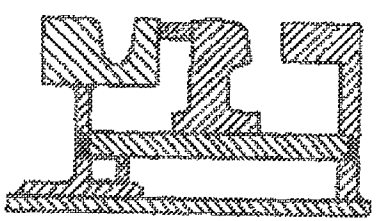
Figure 22:
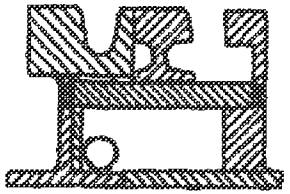

FIG. 6 shows a first variant of a rail with a lower part comprising a flat element, FIG. 7 shows a portion of a rail with a lower part connected metallurgically, FIG. 8 shows a portion of a rail with a lower part connected metallurgically and in a form-fitting manner, FIG. 9 shows a portion of a rail with a lower part connected metallurgically and in a form-fitting manner, FIG. 10 shows a perspective view of a rail with an L-profile as lower part with welded-on plates, and FIGS. 11 to 24 show various variants of switching devices with rails according to the invention's design.

The following description of preferred embodiment example serves to explain the invention's teaching, which in principle is characterized by an upper part—consisting of a wear resistant material such as steel with pearlitic or bainitic structural constitution and a strength of up to 1500 N/mm$^2$ or higher or quenched and drawn constructional steels with a hardness up to 500 HB—is connected preferably in a metallurgical and form-fitting manner to a lower part that consists of structural steel or other suitable low-cost steel that possesses the required strength, whereby the lower part is embodied as a profiled or flat element.

The upper part forms a head of the rail and possesses a rectangular shape in a sectional view, i.e. a cuboid shape overall.

The head in the embodiment examples further possesses a groove along its longitudinal direction, without this placing any limits on the invention's teaching, even though this is to be stated as the preferred case.

The wall thickness of the profiled or flat elements should be at least 10 mm, whereby a preferred value range is 10 mm to 30 mm.

The above-mentioned features and characteristics, which in principle apply to the embodiment examples, shall not be elaborated further in the following. Moreover, identical elements shall on principle carry equal reference labels.

Figure 1:
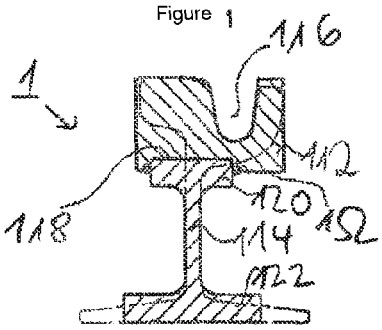
FIG. 1 shows a first variant of a rail with an I-profile as lower part.

FIG. 1 shows a sectional view of a first variant of a rail 1 according to the invention, which consists of a head or upper part 112 and a lower part 114 forming a lower support structure. The head 112, which possesses a cuboid shape and in accordance with above explanations a groove 116 along the longitudinal direction, consists of a wear resistant steel that preferably possesses a basic hardness up to 1,400 N/mm$^2$. A further characteristic quantity is an elongation at failure of at least 9%.

The lower part 114, i.e. the lower support structure, consists of structural steel or a related construction material with characteristics suitable for the indented purpose and is welded to the upper part 112. The embodiment example of FIG. 1 includes in addition a form-fitting connection. For this purpose, a slot 118 extending in the longitudinal direction is incorporated on the lower side 152 of the head 112, into which engages an upper flange 120 of the lower part 114 in the form of an I-profile. The I-profile may in particular be a rolled profile.

In the embodiment example of FIG. 1, the upper flange 120 is of lesser width than the lower flange 122, which forms the foot of the rail 110.

Dotted lines indicate in FIG. 1—and also in FIGS. 2 to 6—a standard profile of a grooved rail.

It is apparent in a sectional view that the lower flange of the I-profile that forms the lower part 114 possesses a rectangular geometry. Moreover, the width is lower than a possible profile of a grooved rail. The same is true for the other profiled elements, which are schematically illustrated in FIGS. 2 to 6.

A metallurgical method is used to connect the upper flange 120 to the head 112 in the usual manner along the exterior contact areas. The weld seams are symbolized by solid triangles.

Figure 2:
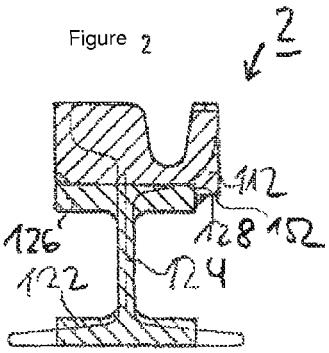
FIG. 2 shows a second variant of a rail with an I-profile as lower part.

While the widths of the upper flange 120 and the lower flange 122 of the rail 1 are different—the upper flange 120 is more narrow than the lower flange 122—in the rail 2 of FIG. 2 the upper flange 128 and the lower flange 122 of the lower part 124 embodied as an I-profile are of equal width. Further, the upper flange 126 on one side is embedded into the head 112 in a form-fitting manner. For this purpose, the head 112 on its lower side 152 possesses a cut-out forming a step with a section 128 that is vertical or substantially vertical, upon which in the embodiment example rests the right longitudinal edge of the upper flange 126 of the lower part 124. This gives rise to a one-sided form-fit along the direction of force, i.e. along the direction of a vector of a force that is introduced by a vehicle passing the rail 2.

Consequently the rail 2 can for example be employed as a curved rail, which predominantly is loaded by the centrifugal force of a vehicle along the force vector to the outside of the arc. Consequently, the normally or substantially normally oriented section 128 extends on the inside of the arc. The section 128 may also be referred to as a demarcation of a cut-out in the lower side of the upper part 112, whereby the demarcation, i.e. the cut, extends in parallel or substantially in parallel relative to the vertical axis of the web of the lower part 124.

Figure 3:
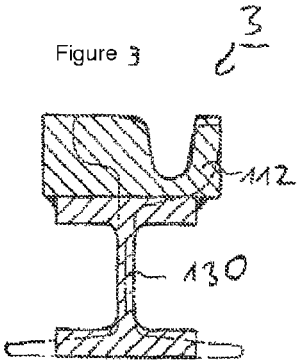
FIG. 3 shows a third variant of a rail with an I-profile as lower part.

The rail 3 illustrated in FIG. 3 differs from the rails 1 and 2 by the fact that the lower support structure 130, which is also an I-profile, in particular a rolled I-profile, is connected to the lower side 152 of the head 112 exclusively in a metallurgical manner, i.e. welded.

Figure 4:
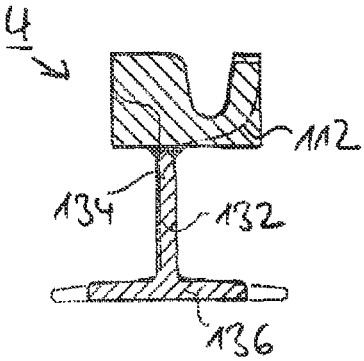
FIG. 4 shows a first variant of a rail with a T-profile as lower part.

FIG. 4 illustrates a rail 4 with an upper part or head 112 that is connected metallurgically to the web 134 of a T-profile 132, the flange 136 of which forms the foot of the rail.

Figure 5:
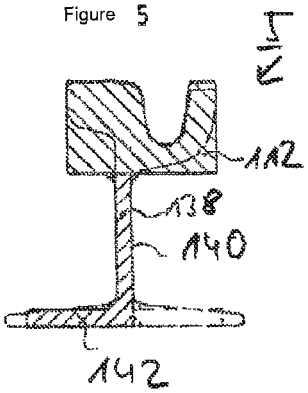
FIG. 5 shows a first variant of a rail with an L-profile as lower part.

In a rail 5 in accordance with FIG. 5, the head, i.e. the upper part 112, is connected to an L-profile 138, in particular via its web 140. The flange 142 of the L-profile 138 forms half of the foot of the rail 5, which on the opposite side is completed by plate elements 156, 158, as shown in FIG. 10.

A lower support structure 144 of the rail 6 of FIG. 6 consists of a vertically extending flat element 146, which is connected metallurgically to a further flat element 148 that forms a foot. The vertically extending flat element 146 is welded to the head 112.

In the embodiment examples of FIGS. 4 to 6, only a metallurgical connection is created and no additional form-fitting one. A design of this nature is suitable if the rail is subject to only low lateral loads or other load-bearing support structures are present that ensure that only low stresses act upon the weld joints (solid triangles).

FIG. 7 again schematically illustrates a section of a profiled or flat element 150, which is butt-jointed to the lower side 152 of the upper part 112 forming the head and is welded to the lower side 152.

The lower side of the head defines a plane or several planes that are connected via a step and extend in parallel relative to each other, each of which is normal or substantially normal with respect to the vertical axis of the rail.

FIGS. 8 and 9 illustrate that profiled or flat elements in accordance with FIGS. 4 and 6 can also be connected to the upper part 112 in a form-fitting manner, whereby FIG. 8 schematically illustrates the lateral form-fit in accordance with FIG. 2.

In contrast, as illustrated in FIG. 9, the free end of the profiled element 150 engages into a slot 154 present in the lower side 152 of the upper part 112 for obtaining the desired form-fit.

FIG. 10 shows a perspective view of the rail 5 of FIG. 5. As mentioned before, the flange 142 here forms one half of a foot. The remaining half of the foot is realized in sections by plate-like elements 156, 158, in particular in those sections where the rail 5 is clamped down. The corresponding plate-shaped elements 156, 158 are welded to the web 140 on the foot side. These measures consequently create the usual constructional options, so that the rail 5 can be fastened in the usual manner.

The rails according to the invention are employed in particular in those regions of a track that are expected to be subject to increased wear. Consequently, these rails are in particular intended to be inserted into switching devices.

Figure 13:
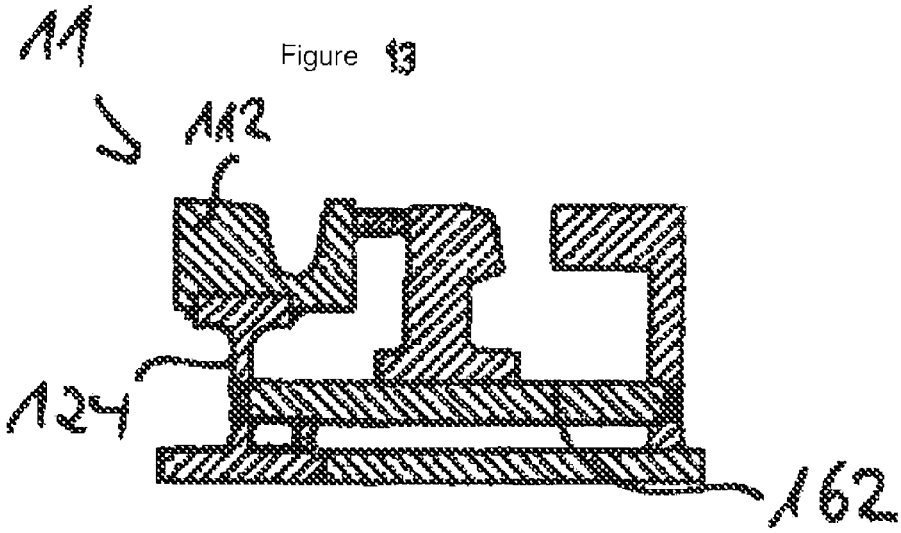
Figure 17:
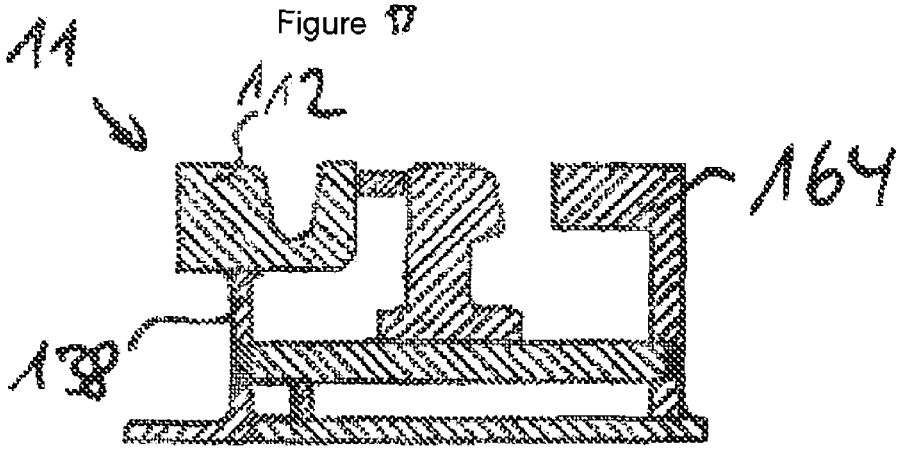
Figure 21:
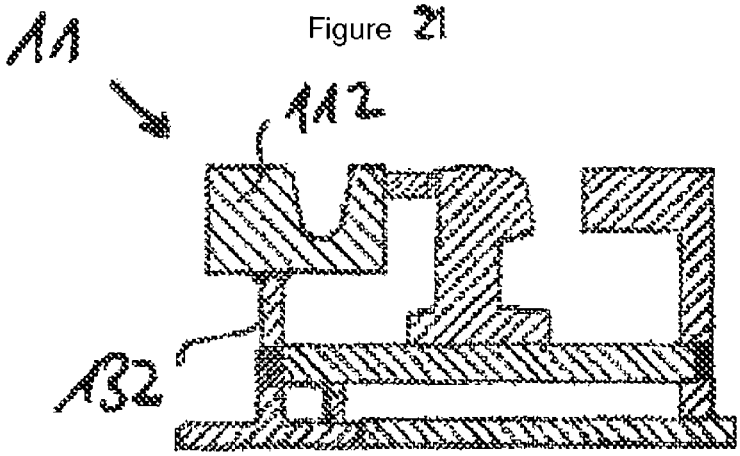

In the embodiment examples of FIGS. 13, 17, and 21 the rigid rail is not arranged on a base plate 170, but beside the latter, whereby the cuboid-shaped head parts 112 can be connected to lower parts 114, 138, 132, as they were described with the help of FIGS. 1, 5, and 4.

By applying the invention to components of points, in particular switching devices, one obtains—in particular for grooved rail points—a multitude of combinations in dependence upon the required build, as is illustrated in a self-explanatory manner in FIGS. 11 to 24.

Shown in these figures are sectional views of switching devices of grooved rail points, whereby illustrated on the left is always a rigid rail 11, 12 that with respect to design and structure corresponds to the rails of FIGS. 1 to 9. The figures also illustrate that the invention's rails can be employed in points or switching devices for flat bed (see e.g. FIG. 11) or drop bed (see e.g. FIG. 13) systems. The rigid rail 11, 12 may be arranged on a base plate 170 or may possess the height of a standard rail, as they are employed in switching devices.

The sectional views further illustrate that relative to the respective rigid rail 11, 12 a tongue blade 160 is arranged adjustable upon a slide plate 162, which preferably is metallurgically connected, i.e. welded, to the web of the rigid rail 11, 12. A side steel plate 164 extends in the usual manner alongside the tongue blade 160 on the side opposite to that of the rigid rail.

The slide plate 162 forms the upper limit of a chamber 166, which on its lower side is limited by the base plate 170 and along its longitudinal sides by the web of the rigid rail 11, 12 or a flat element extending along the latter on the one hand and by the web of the side steel plate 164 on the other. A heating system 168 may extend within the chamber 166 formed in this manner.

The invention claimed is:

1. A rail, comprising:

an upper part forming a head and having a cuboid shape; and a single-part lower part;

wherein a lower side of the upper part is connected to the lower part in at least a metallurgical manner, wherein the lower part comprises a web and is configured as a profiled element having an I-profile in cross-section;

wherein the lower part comprises a base section that extends transversely relative to the web, and wherein the upper part comprises, on its lower side, a cut-out forming a step with a vertically or substantially vertically extending section, to which the profiled element connected in a one-sided form-fitting manner, wherein the profiled element is in contact in a form fitting manner with the vertically extending section, through which a centrifugal force generated by a vehicle passing the rail can be transferred into the profiled element.

2. The rail of claim 1, wherein the base section has a geometry different from that of a standard rail.

3. The rail of claim 1, wherein the base section has a cuboid geometry.

4. The rail of claim 1, wherein the base section has a width that is less than a foot width of a standard rail.

5. The rail of claim 1, wherein the profiled element is manufactured by rolling.

6. The rail of claim 1, wherein the profiled element comprises a minimum wall thickness of 10 mm.

7. The rail of claim 1, wherein the upper part is produced by rolling and comprises an incorporated groove or a contour corresponding to that of the head of a grooved rail.

8. The rail of claim 1, wherein the rail can be used as a rigid rail of a switching device.

9. The rail of claim 1, wherein the rail can be used as a check rail, and/or weld-on rail, and/or standard rail.

10. The rail of claim 1, wherein the rail is a grooved rail or a Vignoles rail.

11. A switching device with a rail of claim 1, wherein the rail extends from the beginning to the end of the switching device extends from the beginning to the end of the point blade opening of the switching device.

12. The switching device of claim 11, wherein the rail in the switching device originates from a base plate or has a regular rail height.

13. The rail of claim 1, wherein the upper head part is manufactured from a wear-resistant material.

14. The rail of claim 1, wherein the lower part is manufactured from structural steel.

15. The rail of claim 1, wherein the upper part and lower part are manufactured from different materials.

16. The rail of claim 6, wherein minimum wall thickness is a thickness d with 10 mm≤d≤20 mm.

* * * * *